United States Patent [19]

Odeau

[11] Patent Number: 4,549,728

[45] Date of Patent: Oct. 29, 1985

[54] SUCTION/AIR PRESSURE DEVICE FOR SLOWING DOWN SIGNATURE IN CHOPPER FOLDER OF FOLDING MACHINE

[75] Inventor: Michel Odeau, Creil, France

[73] Assignee: Harris-Marinoni S.A., Montataire, France

[21] Appl. No.: 616,393

[22] Filed: Jun. 1, 1984

[30] Foreign Application Priority Data

Jun. 6, 1983 [FR] France ..... 83 09350

[51] Int. Cl.[4] ..... B42C 1/00

[52] U.S. Cl. ..... 270/46; 493/418

[58] Field of Search ..... 270/19, 12, 15, 46; 493/418, 416, 450, 457, 444

[56] References Cited

U.S. PATENT DOCUMENTS

| | | | |
|---|---|---|---|
| 396,308 | 1/1889 | Stonemetz | 270/46 |
| 3,252,700 | 5/1966 | Henry | 493/418 |
| 3,632,104 | 1/1972 | Dufour | 493/444 |
| 3,785,636 | 1/1974 | Bitting et al. | 493/418 |
| 3,879,029 | 4/1975 | Cruden | 493/450 |
| 3,916,790 | 11/1975 | Alix | 493/418 X |
| 3,926,425 | 12/1975 | Pierce et al. | 493/444 |
| 3,927,875 | 12/1975 | Winnemoller et al. | 493/448 X |
| 4,419,088 | 12/1983 | Nemec | 493/457 |

FOREIGN PATENT DOCUMENTS 2837392 2/1980 Fed. Rep. of Germany ..... 493/450

*Primary Examiner*—E. H. Eickholt

*Attorney, Agent, or Firm*—Yount & Tarolli

[57] ABSTRACT

A device for slowing down signatures to be folded in a chopper folder is disclosed comprising a table formed with a slot therein parallel to the direction of movement of the signatures, a headstop perpendicular to such direction, two fold rollers disposed below the slot, and a blade cooperating with the fold rollers for folding the signatures centered with respect to said slot, and further comprising a device for applying vacuum or under pressure acting upon each signature to be folded to slow it down progressively as it approaches the headstop, the slowing down force being applied to prevent bouncing of the signature off said headstop, on the one hand, and on the other hand, to produce tension in the signature until the vacuum is suddenly brought to atmosphere, the vacuum device comprising at least one series of holes disposed in accordance with the direction of movement of the signature to be folded in order to be obturated thereby one after the other until obturation of all the holes in the series of holes, which corresponds to maximum vacuum and thus maximum slow down of the signature, the vacuum device comprising a box secured under the table with the series of holes being formed in the table.

8 Claims, 7 Drawing Figures

SUCTION/AIR PRESSURE DEVICE FOR SLOWING DOWN SIGNATURE IN CHOPPER FOLDER OF FOLDING MACHINE

This invention relates to improvements in chopper folders with blade which are used as the final station of folding machines operated in relation to rotary presses.

The knowledgeable persons in the art know that these folding machines realize various folds and operations as mentioned in the following:

triangle fold or sometimes longitudinal cutting into two ribbons or more, with use of turning bars to super impose such ribbons;

longitudinal and/or transverse perforation or creasing to prepare the subsequent folds;

cutting between two cylinders one of which is provided with a saw along at least one of its generatrices;

realization of the first fold which is perpendicular to the direction of movement of the web by means of a tucking blade mounted to one of the cylinders and introducing the signatures into a jaw carried by the adjacent cylinder;

taking the signatures in driven belts on the periphery of the folding cylinder (by means of four or more belts driven in parallel relationship to one another) such as to bring them to the chopper folder;

realization of the chopper folder (parallel to the triangle fold and the direction of motion of the paper). The invention resides in this point;

slowing down the signature in spiders which lay it down the delivery belt.

In a conventional chopper folder (see FIGS. 1 to 3 of the attached drawings) which the invention intends to improve the signatures 1 are taken from the folding cylinder 2 by a plurality of belts 3 and 4 to be brought to the chopper folder proper 30.

On the folding cylinder which rotates for example in the anticlock-wise direction there are a certain number of folding couples constituted by fixed jaws 5 machined in the cylinder itself (slots parallel to a generatrix of the cylinder) and a movable blade or "jaw blade" 6 cooperating with jaws 5. As cylinder 2 rotates in the direction of the arrow a cam opens the blade 6 while a plurality of fixed strippers 7 mounted in a plurality of circular grooves machined in the cylinder 2 remove the signature from the jaw.

A loop of belts 3 leaning over the sheets through a return pulley 8 and driven at the press speed through a drive roller 9 maintains the sheets in a straight line.

Another loop of driven belts 4 mounted under the sheet 1 drives the latter to the chopper folder. This loop is mounted between a return idle pulley 10 mounted adjacent the strippers and is driven by a controlled roller 11.

The sheet 1 stripped from the jaw 5 and 6 is actually squeezed between belts 3 and 4 to be driven to the chopper folder.

Generally, there are four upper belts 3 and four lower belts 4 disposed edge to edge on each side. A chopper folder table 12 extends under the lower belts over a length longer than that of the signature. Said table is formed in its center with a slot 13 parallel to the direction of movement of the signatures.

It is significant to note that in most folding machines of this type the signatures move at the machine speed (if no slowing down of the signatures was achieved before this step) and that the signatures have been folded up in two (first fold) and, consequently, are twice as short as the machine cut-off.

Therefore, in this case two signature backbones are spaced by one cut-off, whereas the length of these signatures is only half a cut-off.

This means that there is a space without paper equal to the length of a folded signature between two signatures.

The above described proportions of the space without paper relative to the length of the signature may be variable (in particular if there is a slow down in the folding machine or if the fold achieved before the chopper folder is different from a simple folding into two, or first fold) without however departing from the scope of this invention.

The signatures squeezed between the belts 3 and 4 then reach a frontstop or headstop means 14 which is perpendicular to the direction of motion of the paper (see FIG. 3).

Such headstop resting against the chopper folder table 12 is machined and comprises slots 15 therein for allowing passage therethrough of upper and lower belts 3 and 4. The purpose of this headstop is to maintain momentaneously in the resting position the signature when it has reached such point pushed by belts 3 and 4.

Under the slot 13 two fold rollers 16 and 17 turning in opposite directions are driven at the desired speed. The roller 16 rotates clockwise in FIG. 2 whereas roller 17 rotates in the anticlockwise direction. A blade 30 or knife suitalby pivotably mounted to the frame through the axis 18 and moved from top to bottom by the crank pin 19 and the rod 20 introduces the signature 1 between the fold rollers 16 and 17 in order to fold it (see FIG. 2). The crank pin 19 is connected to the machine drive to complete one revolution each time a signature is fed to the chopper folder. The fold rollers 16 and 17 are themselves connected to the machine drive such that the folding speed is sufficient to completely fold a signature before the next one arrives.

The phase of the knife blade of the chopper folder relative to introduction by signatures by the cylinder 2 is such that blade 30 contacts the signature substantially when the latter reaches the headstop.

In high speed folding machines, the signature driven by both belt sets reaches the head stop 14 very quickly and tears off or wrinkles permanently.

Abrupt stopping on the signature backbone of the signature from full speed to complete stop of the machine raises such problems as torn paper bits or not square folds or randomly deviated folds, bouncing on the stop upon contact therewith and before the blade has touched the paper.

All this leads to inaccuracy in the fold.

Several systems are used for slowing down the paper before it comes into contact with the stop and absorbing part of its kinetic energy such as stationary brushes pushed against the table 12 so as to increase frictional forces in the last portion of the travel.

Systems to slow down the sheet by its trailing edge are better since they tend to straighten the sheet but they have the disadvantage of being more complex.

One of the objects of this invention is to slow down the signature when it is directed to the stop; and one advantage of this invention which will be better understood hereinafter is to slow down the signature not only by its backbone forwardly but also by a significant portion of its surface.

Another object of this invention is to prevent wrinkles and dog ears in the last time of the folding, as will be explained hereinafter, and also to exclude bouncing back on the headstop.

In accordance with this invention a device for slowing down the signatures in a chopper folder with knife of a known type comprises means for producing vacuum or underpressure acting upon each signature so as to slow it down progressively as it comes closer to the stop located perpendicularly to the direction of movement of the signatures, and for preventing the signature to bounce back on said stop and avoiding the realization of wrinkles and dog ears by aerodynamic effect in last folding time by producing tension in the paper in the trailing edge of the signatures as they are being folded, then by the vacuum production means being suddenly connected to atmosphere.

The vacuum production means each comprise at least one series of holes disposed according to the travel direction of the signature so as to be obturated by the latter one after the other until obturation of all the holes in the series, which corresponds to maximum underpressure and therefore maximum slowing down of the signature.

Other characteristics and advantages of this invention will appear from the following description which is made in reference to the attached drawings in which.

Figure 1:
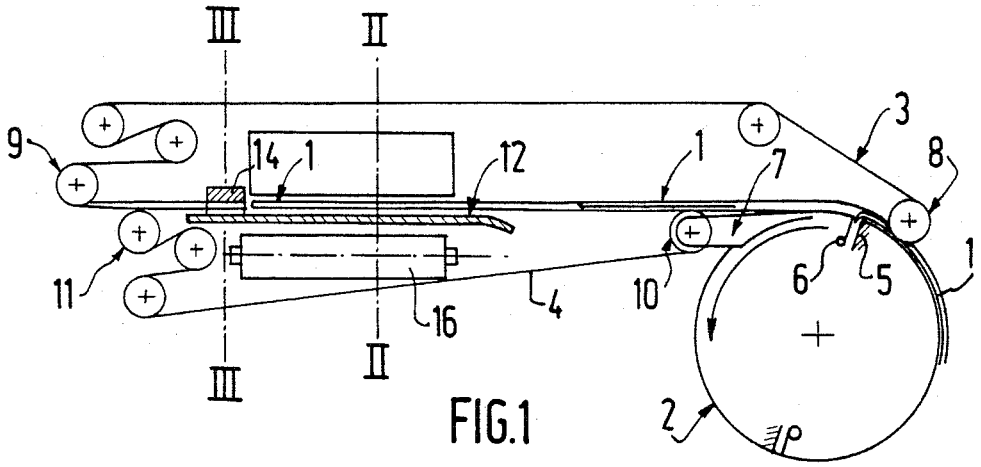
FIG. 1 is a front view partly in section of a conventional chopper folder with blade.
Figure 2:
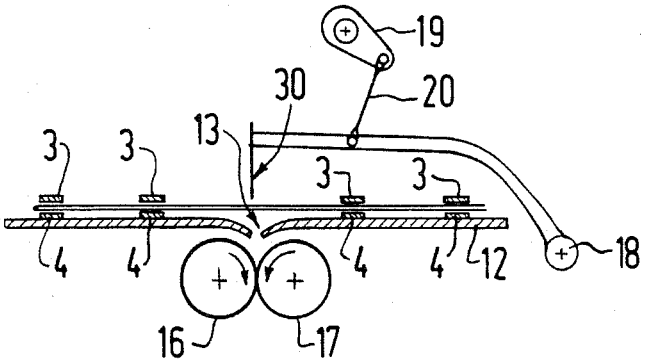
FIG. 2 is a sectional view through line II—II of FIG. 1.
Figure 3:
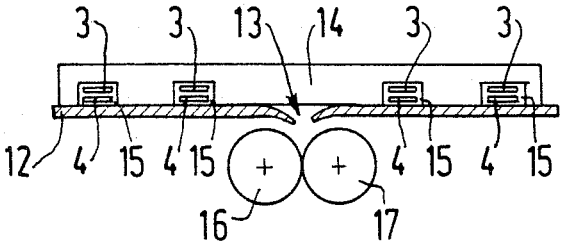
FIG. 3 is a sectional view through line III—III of FIG. 1.
Figure 4:
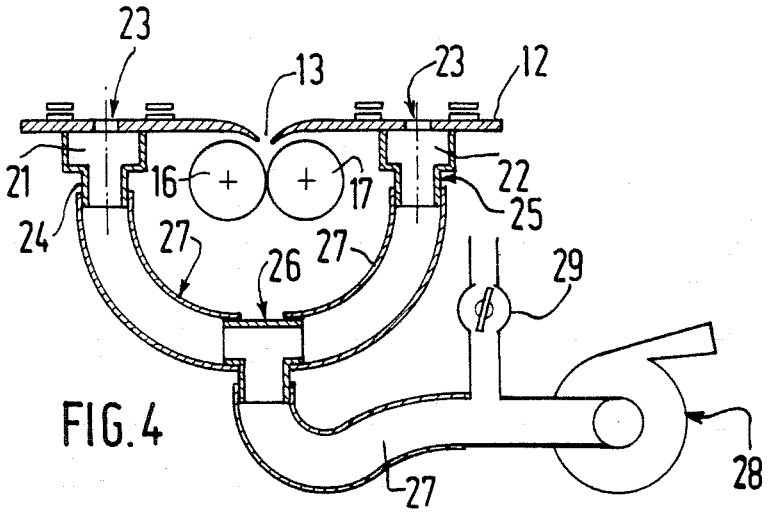
FIG. 4 is a sectional view of a chopper folder with blade provided with vacuum boxes according to the invention.

This invention substantially consists of adding to a conventional chopper folder with blade such as described above two vacuum boxes 21 and 22 extending longitudinally and parallel to the folding rollers 16 and 17 and disposed away from the path of belts 3 and 4. The vacuum boxes are preferably located between two sets of belts on each side of the slot 13 and symmetrically relative thereto.

The vacuum boxes consists of a U-shaped iron closed at both ends by a welded signature secured under the chopper folder table 12 in an air tight manner.

Above the boxes the table is formed with a plurality of holes 23 therein extending over the full length of the box and disposed such that the closest hole with respect to the stop is made at a distance of between 50 and 75 mm from the stop whereas the hole most remote from the stop is at a distance lower than the length of the signature arriving at the chopper folder.

Figure 5:
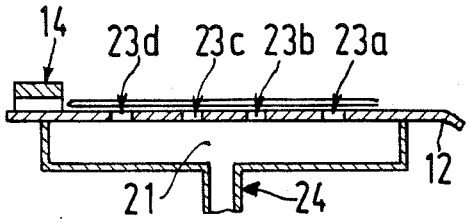
FIG. 5 is a sectional view of one of such boxes through a plane perpendicular to the reading plane of FIG. 4.

Four holes have been shown in FIG. 5 but obviously any number of holes can be made without however departing from the scope of the invention.

The holes may be of a diameter of between 10 and 20 mm or any other suitable diameter.

A pipe 24 welded to the box 21 is used for producing partial vacuum in said box. Similarly, a tube 25 secured to box 22 is also used for this purpose. The pipes 24 and 25 are connected through a flexible to a T-shaped junction 26 such that both sides of the flexible 27 are of the same shape and length.

Starting from the T-shaped junction 26, air is evacuated by a blower 28 through a flexible 27. Such blower is driven in a manner known in itself by an electric motor.

Typical diameter of pipes and flexibles is 50 mm.

The blower may be designed for obtaining an underpressure of 2 meters of water when the flow rate is 200 $m^3/h$.

A throttle valve 29 is disposed as a by-pass to the flexible 27 to permit air to penetrate into the blower 28 directly instead of coming from boxes 21 and 22. Such valve is actuated in a known manner by a remote control motor depending on the speed of the press. The throttle valve is open at low speed and closed at high speed.

The principle of the operation is the following:

When a signature in its movement to the headstop driven by the belts moves above the holes 23*a*, 23*b*, 23*c*, 23*d* it successively obturates such holes.

When the the holes are obturated the vacuum in the boxes 21 and 22 reaches a larger value and the signature is then applied to the table 12 due to the pressure differential between pressure reigning in boxes 21 and 22 and the atmospheric pressure. Friction is produced between the signature and the table, thereby causing the signature to slow down.

During the slow down, the backbone or fold of the signature is not the only one to receive stresses but the friction is exerted over a large portion of the signature.

As the sheet is stopped at the headstop it is folded up by blade 30 which introduces it between both rollers 16 and 17 which cooperate during the folding time.

During this period the next signature 1 continues its movement to the headstop.

The blade 30 as well as the folding rollers draw the signature to the center of the table where there is formed the slot 13 therein into which it disappears below the table 12.

In its travel to the center the signature releases the series of holes 23 in a sudden manner thereby decreasing the vacuum in both boxes.

Figure 6:
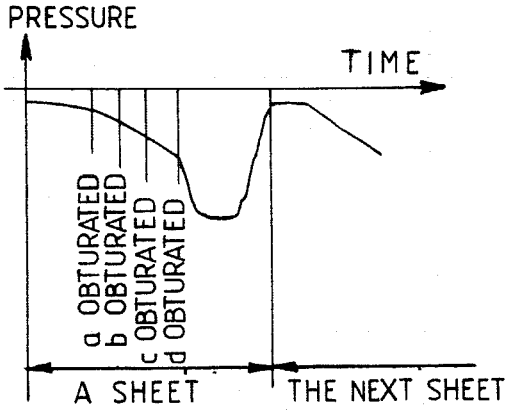
FIG. 6 is a diagram of the vacuum as a function of time.

FIG. 6 is a diagram showing the developments of the vacuum in the boxes as a function of time. The underpressure increases progressively as new holes are obturated by the forward movement of the signature, then suddenly decreases to the atmospheric pressure as soon as the signature being folded simultaneously leaves all the holes open.

The advantage of such vacuum boxes is slowing down the signature on its way to the stop and also to maintain the paper in the tight condition during the folding of the signature thereby reducing problems connected with tear and wrinkle in paper on the blade of the chopper folder.

Another interesting means for realizing this invention is to drive the blower at the speed of the press instead of driving at constant speed by an electric motor.

The usefulness of the throttle valve 29 as described above is to reduce the under-pressure at the low speed of the press.

The reason for this measure is that kinetic energy contained in a signature is proportional to the square of the speed of such a signature, therefore to the square of the speed of the press.

At low speeds such kinetic energy is very low and the vacuum stops the signature too early in its way to the stop; the fold is produced before the stop thereby causing jamming in folding machines.

The vacuum in a conventional blower is roughly proportional to the square of its driving speed, which means that by driving the blower at the machine speed the vacuum is always suitable and proportional to kinetic energy contained in the signature. In this case, the throttle valve 29 would only be used for taking into account the quality of the folded paper, its stock weight and its frictional coefficient on the table but no longer the speed of the press.

The chopper folder described in this specification is only a possible form of embodiment. The specialists in the printing industry know other means for introducing the paper in-between the two fold rollers such as the well known "rotary" or "hypocycloidic" design in which the tip of the blade describes a straight line instead of a circular arc.

It will be understood that this type of chopper folder or other similar design can be used without departing from the scope of the invention since the type of movement of the blades was only described in an indicative manner.

Other alternate embodiments may also include larger vacuum boxes having a greater extent under the table from the side to the center thereof.

Figure 7:
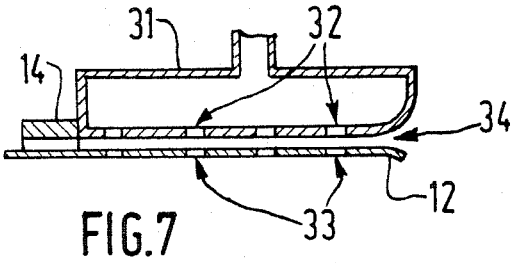
FIG. 7 is a sectional view showing pressurized air boxes instead of vacuum boxes.

Blowing air under pressure above the table realized by over-pressure boxes 31 located above the signature and provided with holes 32 therein opposite to corresponding holes 33 formed in the table (see FIG. 7) also represents an application of this invention, each signature then being able to slide into a passageway 34 formed between said over-pressure boxes and the table.

It will be understood that this invention was only described and represented in a preferential manner and that equivalent parts can be substituted for its constituents without however departing from its scope as defined in the attached claims.

I claim:

1. A device for slowing down signatures to be folded in a chopper folder of a known type comprising a table formed with a slot therein parallel to the direction of movement of the signatures, a headstop perpendicular to such direction, two fold rollers disposed below the slot, and a blade cooperating with said fold rollers for folding the signatures centered with respect to said slot, and further comprising means for applying vacuum or underpressure acting upon each signature to be folded to slow it down progressively as it approaches said headstop, the slowing down force being applied to prevent bouncing of the signature off said headstop, on the one hand, and on the other hand, to produce tension in the signature until said vacuum applying means are suddenly brought to atmosphere, said vacuum applying means comprising at least one series of holes disposed in accordance with the direction of movement of the signature to be folded in order to be obturated thereby one after the other until obturation of all the holes in the series of holes, which corresponds to maximum vacuum and thus maximum slow down of the signature, said vacuum applying means comprising a box secured under said table and said series of holes being formed in said table.

2. A device according to claim 1 wherein said vacuum applying means comprises a blower for producing vacuum and which is driven at a constant speed, and throttle means for controlling the amount of vacuum applied to the signature to be folded.

3. A device according to claim 1 wherein said vacuum applying means comprises a blower for producing a vacuum proportional to the kinetic energy of the signature, and throttle means for controlling the amount of vacuum acting on the signature.

4. A device for slowing down signatures to be folded in a chopper folder of a known type comprising a table formed with a slot therein parallel to the direction of movement of the signatures, a headstop perpendicular to such direction, two fold rollers disposed below the slot, and a blade cooperating with said fold rollers for folding the signatures centered with respect to said slot, and further comprising means for applying vacuum or underpressure acting upon each signature to be folded to slow it down progressively as it approaches said headstop, the slowing down force being applied to prevent bouncing of the signature off said headstop, on the one hand, and on the other hand, to produce tension in the signature until said vacuum applying means is suddenly brought to atmosphere, said vacuum applying means comprising at least one series of holes disposed in accordance with the direction of movement of the signature to be folded in order to be obturated thereby one after the other until obturation of all the holes in the series of holes, which corresponds to maximum vacuum and thus maximum slow down of the signature, said vacuum applying means comprising two boxes disposed under said table on either side of said slot therein and thus of said fold rollers.

5. A device for slowing a signature to be folded in a chopper folder, said device comprising a folding table defining a slot therein, said slot extending in the direction of movement of said signature, stop means extending transverse to the direction of movement of said signature, a pair of fold rollers disposed beneath said folding table and defining a nip therebetween for receving the folded signature therebetween, blade means for driving said signature into said slot and said nip to fold the signature, and means for progressively slowing said signature as it approaches said stop means, said means for progressively slowing said signature comprising means for applying a progressively increasing pressure differential to said signature as it approaches said stop means to thereby prevent bouncing of said signature off said stop means and for tensioning said signature during folding thereof.

6. A device according to claim 5 in which said means for applying a progressively increasing pressure differential to said signature comprises a series of holes formed in said folding table and disposed in accordance with the direction of movement of said signature in order to be obturated thereby one after the other until obturation of all the holes in the series of holes, which corresponds to maximum pressure differential acting on said signature and thus maximum slow down of said signature.

7. A device according to claim 5 in which overpressure boxes disposed above said folding table, with pressure differental acting on said signature varying by successive obturations by said signature passing between said boxes and said folding table of cooperating holes in said boxes and said folding table.

8. A device according to claim 5 in which said means for applying a progressively increasing pressure differential to said signature comprises throttle means for controlling the pressure differential applied to said signature.

* * * * *